United States Patent [19]

Higley

[11] Patent Number: 4,482,155

[45] Date of Patent: Nov. 13, 1984

[54] GOLF CLUB ALIGNMENT INDICATOR APPARATUS

[76] Inventor: Raymond H. Higley, 1401 Briarwood Rd., Atlanta, Ga. 30319

[21] Appl. No.: 431,579

[22] Filed: Sep. 30, 1982

[51] Int. Cl.[3] ..... A63B 69/36; A63B 53/14

[52] U.S. Cl. ..... 273/162 B; 273/164; 273/183 D; 273/32 H; 33/334; 33/389

[58] Field of Search ..... 273/162 B, 32 B, 32 H; 33/334, 389, 163 R, 163 A, 164

[56] References Cited

U.S. PATENT DOCUMENTS

| | | | |
|---|---|---|---|
| 970,360 | 9/1910 | Whigham | 33/334 X |
| 2,204,974 | 6/1940 | Strasser | 273/162 B X |
| 2,806,296 | 9/1957 | Weichert | 33/334 |
| 3,123,358 | 3/1964 | Czarev | 33/334 X |
| 3,242,582 | 3/1966 | Garrett | 273/162 B X |
| 3,909,004 | 9/1975 | Vella | 273/162 B |
| 4,079,520 | 3/1978 | Davis | 273/162 B X |
| 4,114,886 | 9/1978 | Koch | 273/162 B |
| 4,179,125 | 12/1979 | Cone et al. | 273/162 B |

*Primary Examiner*—George J. Marlo
*Attorney, Agent, or Firm*—Jones & Askew

[57] ABSTRACT

An improved golf club alignment indicator apparatus, in which a hemispherical bubble level indicator is attached to the handle grip end of the golf club. The indicator is marked with various indicia so as to provide a golfer with the line of aim to the target area, the angle of the club-face relative to the horizontal and the slope of the ground surface upon which the club rests and from which the shot is being played.

8 Claims, 6 Drawing Figures

GOLF CLUB ALIGNMENT INDICATOR APPARATUS

TECHNICAL FIELD

The present invention relates to the sport of golf, and more particularly, relates to an improved device which enables a golfer to properly align a golf club prior to swinging the club.

BACKGROUND

Golf has long been recognized as a most demanding sport due to the difficulty of developing a consistent and accurate golf swing. A golfer is faced with many variables such as distance, direction and differing ground slopes for which he must adjust his club position. Proper adjustment for these variables requires significant skills which the golfer has traditionally acquired through experience. Developing and maintaining these skills requires that the golfer properly address the golf ball. Ideally, the club face is directed toward the target area at the proper angle and club-to-ground alignment. Once the club is properly oriented, the golfer can make a correct swing.

Various devices are known in the prior art to assist a golfer in orientating the club prior to making the swing. Devices have been provided, as shown in U.S. Pat. No. 4,114,886, that plumb a particular club. Such devices are most limited in scope and unsuitable for use with varying ground slope conditions. Other devices are known in the prior art to assist the golfer in swinging a club. One such device incorporating a bubble level is disclosed in U.S. Pat. No. 4,079,520.

Problems have, however, arisen. Should the golfer be positioned on an inclined surface, such devices are of no assistance unless and until the device is placed in an upright position. Furthermore, such devices are impracticle for use in actual play since they must be transferred from club-to-club, and then properly mounted once the desired club is selected. Another problem in the prior art is a certain lack of flexibility. In actual play, the golfer is faced with a variety of situations requiring special adaptations. For example, a particular shot may call for the vertical loft of a seven-iron to hit over a tree or other hazard, but the distance of a five-iron to reach the target area. Additionally, the ground surface from which the shot is to be played may slope away from the golfer. When confronted with such situations, the golfer will desire to increase the loft of a five-iron to that of a seven-iron, and "close the face" (rotate the club counterclockwise) to avoid "pushing" the shot. No device in the prior art has proven suitable to assist a golfer in making such an adaptation.

BRIEF DESCRIPTION OF THE INVENTION

The present invention solves the above-described problems in the prior art by providing a golf club alignment apparatus that assists a golfer in properly aligning a club regardless of the ground contour, while further providing assistance in making adaptations for situations encountered in actual play. In particular, the invention provides a golfer with the following information: (1) the line of aim (directs the club-face towards the target area); (2) the angle of the club-face relative to the horizontal (the vertical loft of a club as determined by the pitch of the club-face); and (3) the slope of the ground from which the golfer is playing the shot.

Generally described, the improved golf club alignment apparatus of the present invention comprises a spherical bubble level indicator having indicia corresponding to the proper line of aim, the vertical loft of the selected club and the ground slope. By gripping and manipulating the golf club so as to locate the bubble of the indicator at the visual intersection of the various indicium, the golfer brings the club into the desired position from which to make the swing.

The novel construction of the present invention provides for proper alignment of a golf club without any adjustment of the indicator. The vertical loft indicia showing the angle of the club-face are inscribed on the spherical casing of the indicator. As the ground slope becomes inclined, the point of visual intersection of the vertical loft indicia and the ground slope indicia with the bubble indicator will vary according to the positioning of the leading edge of the club-face along the ground surface. Thus, when the bubble is properly aligned according to the indicator, adaptation for varying ground contours is automatically obtained.

Thus, it is an object of the present invention to provide an improved golf club alignment apparatus to assist a golfer in positioning a golf club.

It is a further object of the present invention to provide a golf club alignment apparatus that assists a golfer in aligning a golf club on varying ground slopes.

It is a further object to provide an apparatus that indicates the proper position of a golf club on an inclined surface without having to adjust the device or its mounting.

It is a further object of the present invention to provide a golf club alignment apparatus that assists the golfer in adapting a particular club to various situations.

It is a further object of the present invention to provide a golf club alignment apparatus possessing flexible adaptations to a variety of situations.

It is a still further object to provide an apparatus that provides the golfer with the angle of the club-face relative to the horizontal plane.

It is a still further object of the present invention to provide an illuminated golf club alignment apparatus.

Other objects, features and advantages of the present invention will become apparent from reading the following specification when taken in conjunction with the following drawing.

DETAILED DESCRIPTION OF EMBODIMENT

Figures 1, 2:
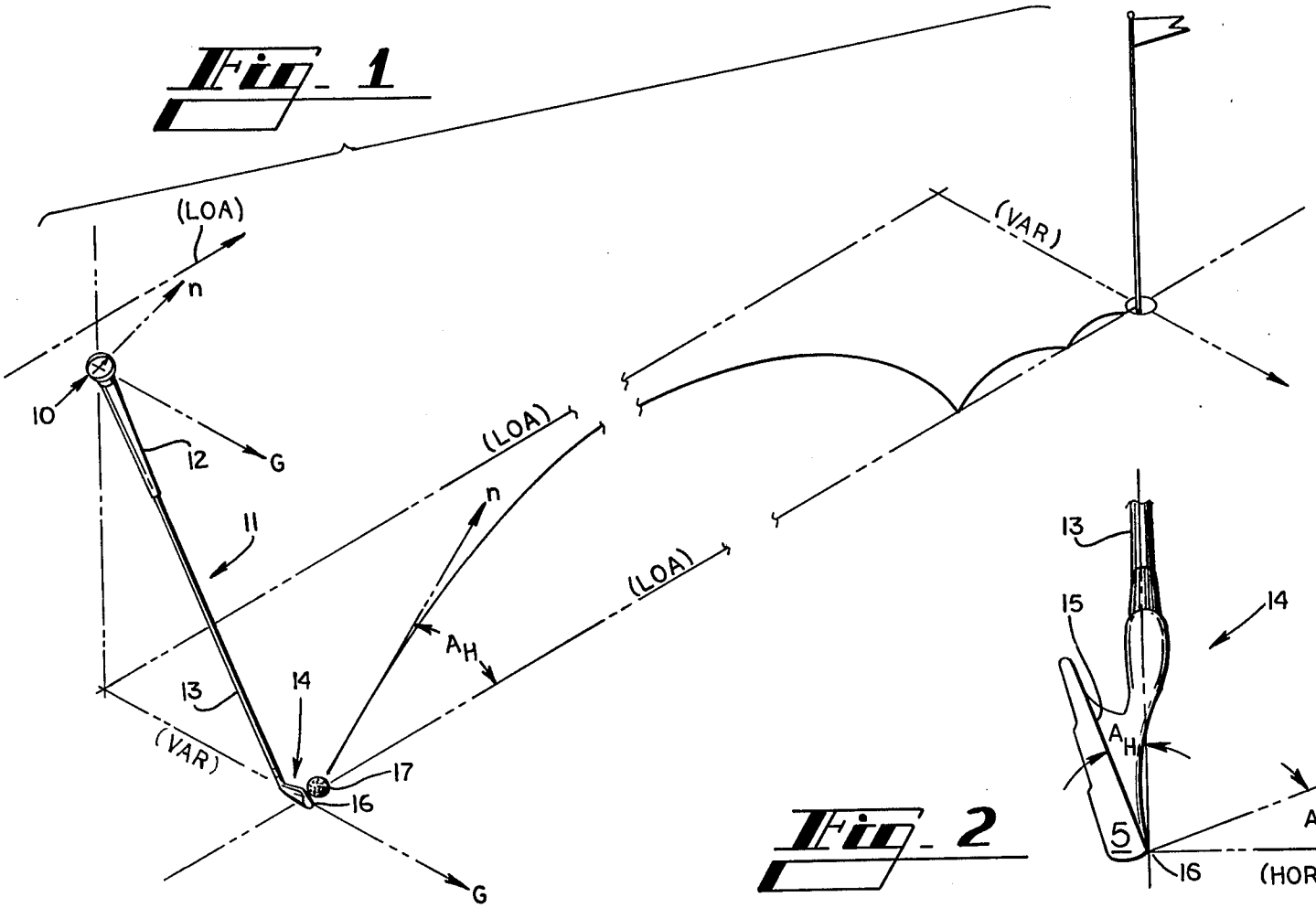
FIG. 1 is a pictorial view of an embodiment of the golf club alignment apparatus according to the present invention, mounted upon a golf club and diagrammatically showing the proper geometric alignment of a club and use of the present invention.
FIG. 2 is an enlarged pictorial view of the head of the golf club shown in FIG. 1, showing a five-iron for illustration.

Referring now in more detail to the drawing, in which like numerals indicate like parts throughout the several views, FIG. 1 shows a conventional golf club 11 having a handle portion 12 by which the golfer grips the club, a shaft 13, and a head 14 which further comprises the contact surface, known in the art as the club-face 15. FIG. 1 further shows a golf club alignment apparatus 10 mounted upon the uppermost portion of the handle 12. It is to be understood that the present invention, when mounted as shown, provides a golfer with the line-of-aim to the target area (LOA), the angle at which the club-face 15 is positioned relative to the horizontal ($A_H$), and the slope of the ground surface as determined by the bottom edge 16 of the club 11.

FIG. 1 also demonstrates certain geometric relationships to be considered. When properly positioned by a golfer, the lowermost portion of the club-face 15 defines an edge 16 (best shown in FIG. 2) that rests upon the plane of the ground surface. The ground slope vector corresponding to this edge 16 is represented herein as the vector G. The club-face 15, as the contact surface, determines two components. First, the angle at which the club-face 15 strikes the golf ball 17 determines the direction in which the ball will travel. The club-face 15 defines a plane containing the ground slope vector G and the line of flight, represented herein by the normal vector n, is perpendicular to the club-face 15. Since the golfer will desire the line of flight to be directed at the target area, the line of flight corresponds to the line of aim, herein represented as LOA. The intersection of a vertical plane containing the normal vector n with any horizontal plane determines a LOA. (The existence of an inherent variance is acknowledged between the line of aim from the golfer's point of reference and the line of flight of the golf ball. This variance is represented in FIG. 1 as VAR.)

The normal vector n also represents the second component determined by the club-face 15, the vertical loft angle $A_H$. As best shown in FIG. 2, the club-face 15 is inclined away from the vertical. This incline defines the vertical loft angle $A_H$ of the club 11. It will be appreciated by those skilled in the art that this component of the normal vector n will differ according to a particular club. For example, the face of a nine-iron club is inclined at a slightly greater angle than that of an eight-iron club and at a far greater angle than that of a two-iron club. As each club will define a unique angle $A_H$ (corresponding to the vertical loft of that particular club-face), it is contemplated that a separate and unique golf club alignment device 10 according to the present invention may be provided for each club. It will be further appreciated by those skilled in the art that a particular club 11 may be manipulated by a golfer so as to further vary the angle $A_H$. It is, however, to be also understood that while the vertical loft angle $A_H$ will vary for each club, the directional component (LOA) also defined by the normal vector n will remain unchanged.

Figure 3:
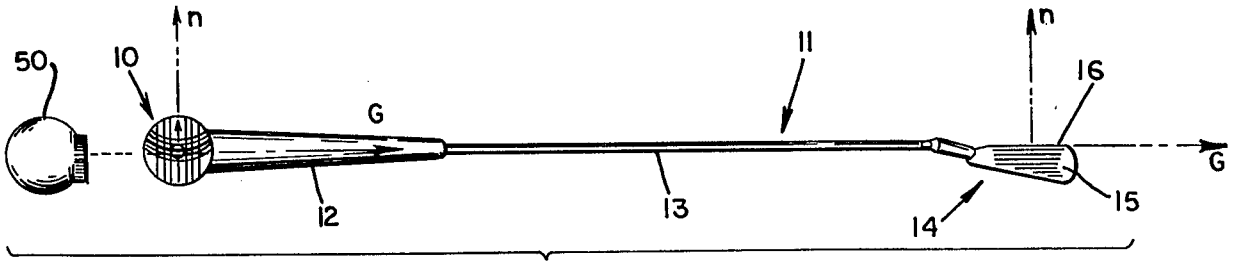
FIG. 3 is a top view of a golf club alignment apparatus as mounted upon a golf club showing the geometric relationships between the club and an embodiment of the present invention.
Figure 4:
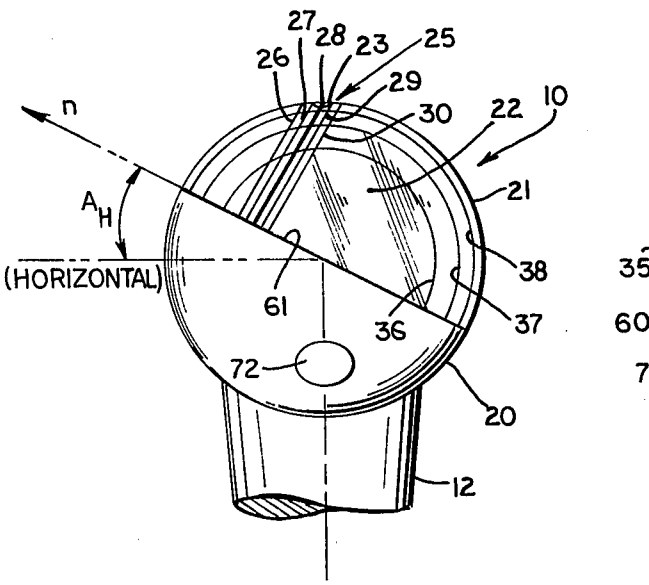
FIG. 4 is a side view of the golf club alignment apparatus shown in FIG. 1.

The disclosed embodiment 10 of the present invention, as shown in FIGS. 3–6, comprises a lower hemisphere 20 and an upper hemisphere 21. The lower hemisphere 20 may be formed of any suitable material such as plastic, wood, or the like, and is affixed to the uppermost portion of the club 11 so that a portion of the lower hemisphere rests within the handle 12 (best shown in FIG. 5). It will be appreciated that the lower hemisphere 20 is mounted at an angle equal to $A_H$, the angle of vertical loft as determined by the inclined club-face 15 (as best shown in FIG. 4). Such an angular mounting, in combination with the novel features disclosed herein, provides the golfer with the angle of the club-face 15 relative to the horizontal surface. Thus, the present invention may be mounted utilizing any suitable means, including bolts, glue or other, so long as the necessary geometric relationships are maintained.

The upper hemisphere 21 comprises a bubble level indicator and may be formed of any suitably rigid, transparent material such as plastic, glass, or the like. A viscous fluid 22, which may be colored, partially fills the upper hemisphere 21 so as to create a cavity of air 23 that floats at the uppermost portion of the upper hemisphere 21. Inscribed on the interior surface of the upper hemisphere 21 are various indicia 25 and 35 operatively associated with the cavity of air 23. The first set of indicia 25 comprises a series of parallel circular markings 26, 27, 28, 29, 30 inscribed about the interior surface of the upper hemisphere 21. These first indicia 25, best shown in FIG. 4, encompass and extend across the upper hemisphere 21 at right angles to the lower hemisphere 20 and have centers coaxially spaced along the marking line 61 disposed on the indicator plane 60 and parallel to the normal vector n, described below in greater detail. Thus, these markings 26–30 denote the position of the club-face 15 relative to the horizontal plane. For example, as illustrated in the drawing with a five-iron club, when the club-face 15 is properly inclined relative to the horizontal at the $A_H$ angle, the cavity of air 23 will rest below the appropriate marking 28 corresponding to the loft of a five-iron. As the ground slope varies from the true horizontal, the cavity of air 23, as the club 11 is properly positioned, will track the appropriate marking 28, thereby holding the angle $A_H$ constant at the position of a five-iron (as illustrated in the drawing). The circular markings 26–30 can be numerically designated to denote the corresponding clubs; for example, marking 28 would be the "5" marking, marking 27 the "6", and so on. The present invention contemplates alternative constructions wherein the club designations are given according to the actual degrees of the angle $A_H$. The numerical club designations, however, have been found to be simpler and of greatest efficiency to the golfer. It is to be further understood that the appropriate indicia 28, as illustrated in the drawing of the preferred embodiment for use with a five-iron, may be shaded or otherwise indicated so as to highlight the indicia 28 for reading ease.

Figure 6:
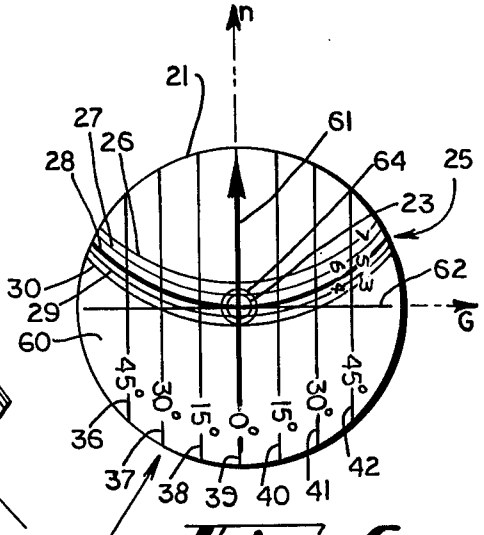
FIG. 6 is a top view of the disclosed golf club alignment apparatus as seen in FIG. 5, showing an application of the present invention.

To further assist a golfer, the preferred embodiment provides a second set of indicia 35 corresponding to the ground slope at which the bottom edge 16 of the club 11 is positioned. As best shown in FIG. 6, the second set of indicia 35 also comprises a series of parallel circles 36, 37, 38, 39, 40, 41, 42 inscribed about the interior surface of the upper hemisphere 21. These indicia, however, run parallel to the marking line 61 and have centers coaxially spaced along the marking line 62 disposed on the indicator plane 60, also described in detail below. This second set of indicia 35 traverse and hence create various visual intersections with the club designation indicia 25 (appearing elliptical to the golfer's view as best shown in FIG. 6) which provide a golfer with information regarding the club alignment. For example, when a five-iron club 11 is properly aligned on level ground, the cavity of air 23 will rest on the visual intersection of the "0°" slope designation 39 and the "5"

elliptical club designation 28. As the cavity of air 23 tracks the appropriate club designation indicium 25, the ground slope designations 35 inform the golfer as to the severity of the incline on which he stands. For example, a golfer having the cavity of air 23 aligned at the visual intersection of the "5" elliptical club designation and the "15°" slope designation 40 would be properly positioned to swing a five-iron club on ground surface inclined upwards and away at a slope of 15 degrees. The numerical workings for the club designation indicia 25 and the slope designation indicia 35 are shown in FIG. 6 positioned to be read by the golfer looking down toward the top of the upper hemisphere 21.

Figure 5:
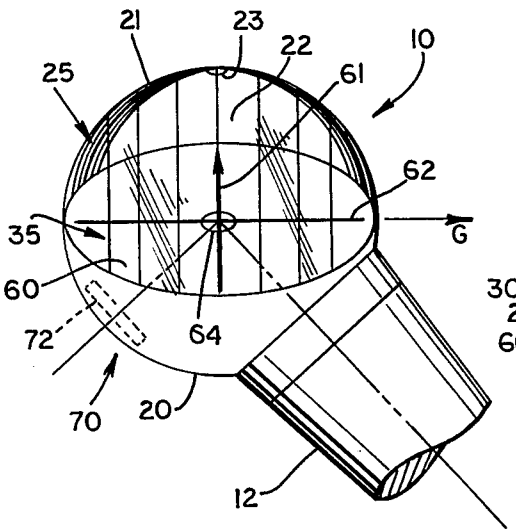
FIG. 5 is a view of the golf club alignment apparatus shown in FIG. 1 as seen from the right side of FIG. 4.

Captured between the lower hemisphere 20 and the upper hemisphere 21 is a flat sheet comprising an indicator plane 60. In the preferred embodiment, the indicator plane 60 is circular in shape and may be formed of any opaque or translucent material (should a light source as disclosed below be incorporated) suitable to provide a background for the indicium of the upper hemisphere 25 and 35 and the markings herein disclosed to be placed upon the indicator plane 60. As shown in FIG. 5, the indicator plane 60 has two markings 61 and 62. The first marking 61 corresponds to the direction in which the club-face 15 is aligned. The second marking 62, perpendicular to the first marking 61, corresponds to the leading edge 16 of the club-face 15 (assumed to be positioned parallel to the ground surface) and provides the golfer with a crosshair-like sighting arrangement as best shown in FIG. 6. At the intersection of the two markings 61 and 62 on the indicator plane 60 is found a circular alignment dot 64. The alignment dot 64 provides further assistance for the golfer since the club 11 will be automatically brought to a known position when the cavity of air 23 is placed directly over the alignment dot 64. It is to be understood that the cavity of air 23 and the alignment dot 64, being at the center of the upper hemisphere 21, provide a vertical reference alignment regardless of ground contour. It will be further appreciated by those skilled in the art that when on level ground, the golfer will have aligned the cavity of air 23 directly within the point of visual intersection of the directional marking 61 and the ground surface marking 62, with the alignment dot 64 and the centermost elliptical indicia 25 denoting the angle of the club-face 15 relative to the horizontal ($A_H$). Thus it is seen that the present invention may be most helpful to a novice golfer seeking to develop a consistent and accurate alignment of a golf club prior to swinging.

It is further contemplated that a light source 70 be included within the lower hemisphere 20 so as to provide a means of illuminating the translucent indicator plane 60. A push button on/off switch 72 (FIGS. 4 and 5) may be provided to be operatively associated with a suitable light source 73 and a suitable power source 74 contained within the lower hemisphere 20. If such an illumination source is provided, it should be understood that the indicator plane 60 must be a light-transmissive material or equivalent. The details of such lighting are well known in the art and hence need not be further disclosed herein. As shown in FIG. 3, a cover 50 is also contemplated to protect the apparatus 10 when not in use. Such items are also well known in the art and hence need not be further disclosed herein.

One skilled in the art will recognize that the preferred embodiment of the present invention maintains and utilizes the geometric relationships herein discussed to assist a golfer. As noted, the marking 61 disposed on the indicator plane 60 corresponds to the alignment of the club-face 15 which determines the direction the ball 17 will travel. Moreover, the indicator plane 60 is carried by the lower hemisphere 20 which is mounted at the angle of vertical loft $A_H$. Thus, the directional marking 61 represents the normal vector n transposed to the indicator plane 60 and the apparatus therefore provides the golfer with the line-of-aim (LOA), the vertical loft angle $A_H$ and the ground slope G when viewed along the vertical line defined by the cavity of air 23 and the alignment dot 64.

One skilled in the art will further recognize the present invention to be advantageous over prior art devices in that a golfer may properly align the club 11 on ground surfaces having varying slopes without need of adjusting the apparatus. As shown in FIG. 3 and FIG. 6, the golfer will view the club designation indicia 26–30 (denoting proper club-face positioning relative to the horizontal) as portions of ellipses. As the bottom edge 16 of the club 11 is placed on a surface inclined towards or away from a golfer, the cavity of air 23 will track the appropriate ellipse as the golfer adjusts the position of the club relative to the horizontal. The ground slope indicia 35 will inform the golfer as to the severity of the incline. It will be further appreciated that the present alignment apparatus 10 provides the golfer with a mechanism whereby he may adjust a particular club-face 15 to the vertical loft of another club. For example, should the golfer be unable to use a three-iron to make a particular shot, the present invention provides a means whereby the golfer may accurately change the vertical loft of a five-iron to that of a three-iron. Regardless of the ground surface slope, the golfer would simply manipulate the club 11 so as to position the cavity of air 23 upon the three-iron marking 30. Thus, the club-face 15 would be positioned at the incline of a three-iron and the golfer could make the shot. A device providing such assistance to a golfer is unknown in the prior art.

It should be understood that the foregoing relates only to preferred embodiments of the present invention and that numerous modifications or alterations may be made therein without departing from the spirit and scope of the invention as set forth in the appended claims.

I claim:

1. An alignment indicator apparatus for a golf club, said apparatus comprising:

a fluid-filled housing connectable to the uppermost end portion of a golf club, said golf club having a face portion of predetermined vertical loft and a leading edge;

float means contained within said housing and operatively associated with the fluid in the housing for indicating true vertical;

a first marking indicium (28) comprising a circular line disposed on said housing for visual correlation with said float means, said first marking indicium (28) corresponding to the vertical loft of said face of said golf club; and second marking indicia (35) comprising a plurality of parallel circular lines disposed on said housing so as to each visually intersect said first marking indicium (28) and for visual correlation with said float means, said second marking indicia (35) indicating certain degrees of incline relative to the horizontal upon which said golf club is placed, as defined by said leading edge of said golf club, whereby directing said face portion along a desired line-of-aim perpendicular to said face portion of said golf club, and locating said float means at a point on said first marking indicium (28) properly orients said face portion of said golf club according to said predetermined vertical loft, and viewing said float means relative to said second marking indicia (35) indicates said degree of incline relative to the horizontal upon which said golf club is placed.

2. The apparatus of claim 1, further comprising:

a plurality of circular lines (26), (27), (29), (30) parallel to said first marking indicia (28);

said plurality of circular lines (26), (27), (29), (30) in combination with said first marking indicium (28) comprising indicium (35) corresponding to said predetermined vertical loft of said face of the particular golf club and the predetermined vertical lofts of the faces of at least two immediately preceding and two immediately succeeding golf clubs, relative to said vertical loft of said particular golf club;

whereby directing said face portion along a desired line-of-aim perpendicular to the face of the particular club, and locating said float means at a point on a selected one of said indicia (26), (27), (28), (29), (30) orients said face portion of said particular golf club according to the predetermined vertical loft selected, thus positioning said face of said particular golf club so as to provide the effective vertical loft of that golf club corresponding to the selected indicia (26), (27), (28), (29) or (30).

3. The apparatus of claim 1 further comprising a third marking indicia (61) for indicating the line-of-aim along which the face of said golf club is directed.

4. The apparatus of claim 1 wherein said housing comprises a transparent hemisphere.

5. The apparatus of claim 1 further comprising:

a reference plane surface contained within said housing and having a third marking indicium (61) for indicating the line-of-aim and corresponding to the alignment of said face of said golf club; and said reference plane surface further having a fourth marking indicium (62) corresponding to said leading edge of said face portion of said golf club and intersecting said third marking indicium so as to create a sighting cross-hair within said housing and visible from outside the housing.

6. The apparatus of claim 1 wherein said indicator comprises a light-emitting means operative to illuminate said indicator.

7. The apparatus of claim 6, further comprising switch means for selectively operating said light-emitting means.

8. A golf club alignment apparatus for attachment to a golf club, said golf club having a face portion defining an angle of predetermined vertical loft and a leading edge, the apparatus comprising:

a bubble level indicator comprising a bubble contained within a transparent hemisphere partially filled with a viscous transparent fluid so as to constantly denote true vertical;

a reference surface operatively associated with said indicator;

a first marking line (61) disposed on said reference surface in predetermined alignment with the directional alignment of the face portion of the golf club;

a second marking line (62) disposed on said reference surface in predetermined alignment with the leading edge of the face portion of the golf club, said second marking line (62) being perpendicular to said first marking line (61);

an alignment mark (64) disposed on said reference surface at the intersection of said first marking line (61) and said second marking line (62) so as to provide a cross-hair sighting arrangement within said bubble level indicator;

a third marking indicium (25) comprising a series of parallel circular lines (26), (27), (28), (29) and (30) disposed on said transparent hemisphere and having centers coaxially spaced along said first marking line (61), said series of parallel circular parallel lines (26), (27), (28), (29) and (30) indicating the angle at which the face of the golf club is positioned, said circular line 28 corresponding to the proper position of the face portion of the golf club according to said angle of predetermined vertical loft for that golf club;

a fourth marking indicium (35) comprising a series of parallel circular lines 36, 37, 38, 39, 40, 41 and 42 disposed on said transparent hemisphere and having centers coaxially spaced along said first marking line (61) disposed on said reference surface, said fourth marking indicium (35) corresponding to the slope of the ground surface on which said leading edge of said golf club is positioned; and means for mounting said reference surface and said bubble level indicator to the uppermost end of the handle of the golf club at an angle equal to said angle of predetermined vertical loft for that golf club, whereby aligning said first marking line (61) with the line-of-aim along which a golf shot is to be played, and locating said bubble at the visual intersection of any of said third marking indicium (25) and said alignment mark (64) positions the face of the golf club at the desired vertical loft, and viewing the position of said bubble relative to said fourth marking indicium (35) indicates the slope of the ground surface on which said leading edge of said golf club is placed.

* * * * *